United States Patent [19]

Jaffe

[11] 4,033,057

[45] July 5, 1977

[54] MARKING TAPES FOR MARKING ARTICLES

[75] Inventor: Walther Jaffe, Lidkoping, Sweden

[73] Assignee: Lebema Eledtriska Aktiebolag, Nykoping, Sweden

[22] Filed: May 28, 1975

[21] Appl. No.: 581,959

[30] Foreign Application Priority Data

May 29, 1974 Sweden ..... 7407122

[52] U.S. Cl. ..... 40/21 R; 40/19; 40/316

[51] Int. Cl.[2] ..... G09F 3/18

[58] Field of Search ..... 40/10 R, 21 R, 21 C, 40/21 A, 21 B, 19, 316, 10 D

[56] References Cited

UNITED STATES PATENTS

| | | | |
|---|---|---|---|
| 2,641,074 | 6/1953 | Richmond | 40/19 X |
| 3,068,600 | 12/1962 | Blanchet | 40/316 |
| 3,121,966 | 2/1964 | Upton | 40/10 R X |
| 3,491,470 | 1/1970 | Geisinger | 40/21 R X |

*Primary Examiner*—John F. Pitrelli
*Attorney, Agent, or Firm*—Imirie, Smiley & Linn

[57] ABSTRACT

Marking tapes for marking articles is described. The marking tape consists of a tubular hose or cover of a soft and transparent material. The cross section of the hose or cover may be of circle or of rectangular form and have a diameter length being somewhat less than the width of marking plates to be inserted in the hose or cover. The hose or cover will be provided with spaced holes and/or lugs for fastening of the hose or cover onto articles. The ends of a single hose or cover may be furnished with end closures serving as to stiffen the end portions and having fastening holes for mounting the hose or cover onto the articles especially if the hose or cover is devoid of holes. The hose or cover is made from pre-fabricated carrier hose which is cut into sections or segments.

7 Claims, 11 Drawing Figures

MARKING TAPES FOR MARKING ARTICLES

The present invention relates to marking tapes for marking articles or components, which may be electric cables, electronic components, pipe conduits, electrical fittings or any other similar articles which may require convenient and rapid indentification. It is previously well-known, for such marking purposes, to use marking strips in the form of tape or similar designs, and where discrete marking plates are disposed on a support or carrier to display a combination of specific signs characterizing the article or component.

Such prior-art marking strips, however, usually suffer from one or more drawbacks, in that for instance there may be difficulties in attaching them to the article, they may easily be removed, completely or in part, whereby the article will lose its marking or will be incorrectly marked, or a marking strip attached to the article may be subject to wear or soiling so as to become illegible.

Said drawbacks are obviated by the marking strip or tape according to the present invention which is characterized in that said support or carrier is in the form of a soft and transparent tubular cover the inner diameter of which is fitted to the width of the marking plates in manner to cause the marking plates, when inserted into the cover, to be retained therein with the signs of the marking plates readable through the carrier which, with the marking plates inserted in place, can be attached to the article to be marked. In addition to the above mentioned drawbacks being obviated, the marking tape according to the invention will enable great flexibility in carrying out any desired marking procedure, and the operation of marking various articles or components will be highly facilitated. Thus, by inserting the labeled marking plates into the transparent carrier cover, a satisfactory protection will be obtained against wear and unauthorized removel of one or more marking plates. Furthermore, the fact that the diameter of the tubular cover is fitted to the width of the marking-plates will result in a secure retainment of the marking plates.

As will be obvious from the appended claims, a simple and reliable attachment of the marking tape to the article or component will be obtained by means of holes or apertures made in the carrier cover. Further, a simple method of manufacturing the marking tape of the invention will be obtained owing to the fact that the marking tape can be assembled from a pre-fabricated carrier hose which is cut into sections or segments into which sections or segments of one or more marking-plate strips well-known per se are introduced.

The marking tape according to the invention will be described more in detail hereinafter with reference to the accompanying drawings, in which.

Figure 1:
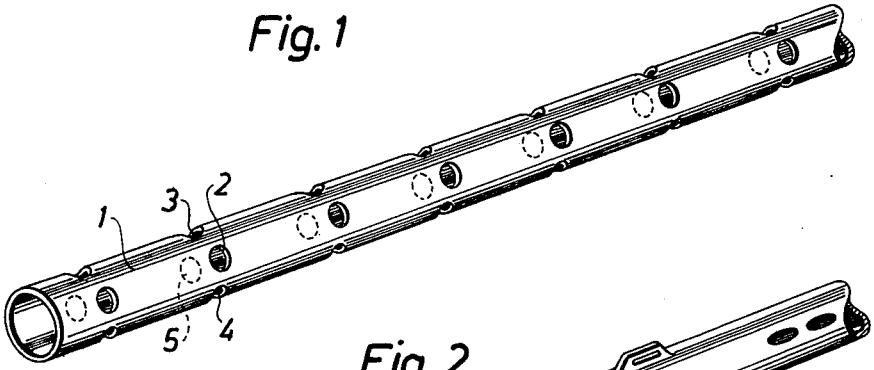
FIG. 1 illustrates one embodiment of a tubular carrier hose for the marking tape according to the invention.

FIG. 1 illustrates a pre-fabracated carrier hose 1 which is adapted to be the basic element of the marking tape according to the present invention. The adaptation of this basic element, which is constituted by a carrier section cut off from the carrier hose 1, will be described more in detail hereinafter with reference to FIG. 4. The carrier hose 1, as shown in FIG. 1, is perforated by a plurality of holes 2, 3, 4 and 5 made in the hose wall. These holes are disposed along generatrices of the peripheral surface of the hose, thus along straight lines extending in parallel relation to the centre axis of the hose. In the embodiment of the hose 1 illustrated in FIG. 1, the holes are arranged in pairs in diametrically opposite positions. It would be possible also to make holes in other positions so that the holes associated with any given generatrix, such as the holes 2 for example, will form groups of two or more holes. It is possible, also, to omit one or more longitudinal rows of holes. The functional utilization of these holes 2, 3, 4 and 5 will be described later in conjunction with FIGS. 5 through 8. The carrier hose 1 is made of a transparent material, for instance of perfectly clear PVC, and should be thin-walled and highly ductile, as well as elastical to some extent.

Figure 2:
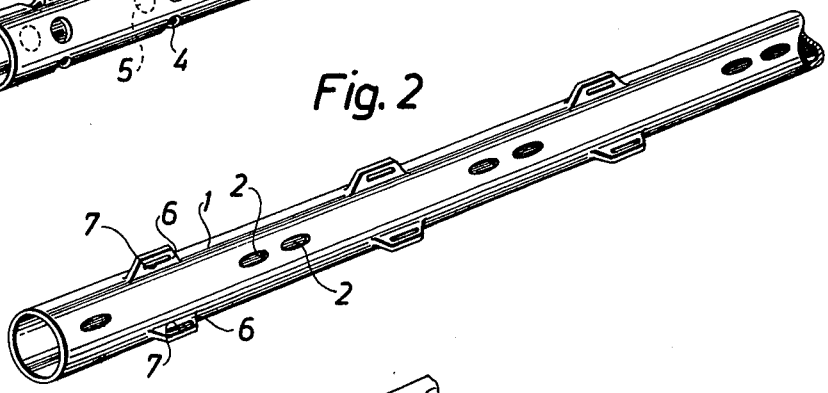
FIG. 2 illustrates another embodiment of the tubular carrier hose for the marking tape according to the invention.

A second constructional form of the carrier hose 1 is shown in FIG. 2, this carrier hose, as well, being made of a transparent material having the above mentioned properties. Also, the carrier hose 1 of FIG. 2 has perforations 2, which, however, are grouped in pairs along one single generatrix. The carrier hose 1 further has a plurality of lugs 6 which are suitably press-moulded integrally with the hose material to project outward from the peripheral surface of the hose. Said lugs 6 are provided with recesses 7 which may either throughgoing or, as indicated in FIG. 2, completely closed. The lugs 6 are also disposed along lines extending in parallel relation to the centre axis of the hose 1. The lugs 6 are suitably arranged along two diametrically opposite generatrices, although it may be conceivable to use one single row of lugs 6. The lugs 6, in a manner similar to that of the holes 2, may be grouped in pairs, and their function in use will be described more in detail hereinafter in conjunction with FIGS. 5 through 8.

Further constructional forms of the carrier hose or tube can be obtained by combinating the two forms thereof illustrated in FIGS. 1 and 2.

Figure 3:
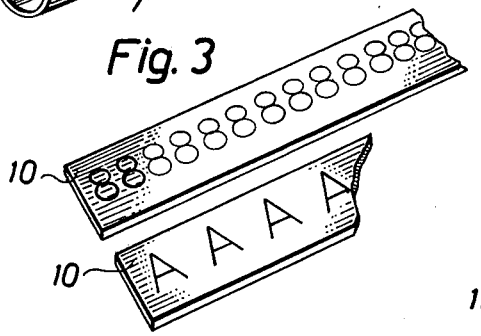
FIG. 3 illustrates marking-plate strips of a kind previously known.

FIG. 3 illustrates marking-plate strips 10 of a kind previously knowm. Such marking-plate strips are prefabricated with various signs and in various colours and are sold in the form of continuous lengths. When using such marking-plate strips the signs desired are severed and are combined into a desired marking combination on a support or carrier surface.

Figure 4:
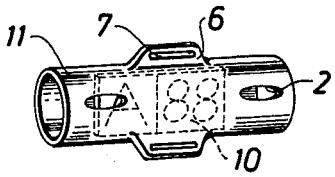
FIG. 4 illustrates a carrier section as cut from the carrier hose of FIG. 2.

The marking-plate strips 10 shown in FIG. 3 can be used in association with the carrier hoses or tubes 1 already described for forming a marking tape according to the present invention, as shown in FIG. 4. In this connection, the diameter of the carrier tubing 1 is so dimensioned as, upon flattening the tube 1, to result in a maximum cross-sectional dimension which is slightly less than the width of the marking-plate strips 10.

Thus, a marking tape according to the invention will be obtained by first severing from the carrier hose or tube 1 a section 11 of a length suited to the desired marking. Then the signs for combining the desired marking are severed from the marking-plate strips 10.

Each such marking plate is than introduced into the carrier hose section or cover 11 which, owing to its elasticity, will retain the marking plates 10 thus inserted. Owing to the transparency of the cover section 11, a clearly readable marking tape is thereby obtained, in which the legend, or designation, is satisfactorily protected against soiling and wear.

FIGS. 5 through 8 illustrate the manner in which the marking tape according to the invention can be applied to various articles or components by utilizing the holes 2 and recesses 7 made in the carrier section or cover 11, 15.

Figure 5:
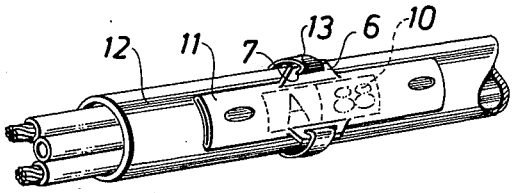
FIGS. 5 through 8 illustrate the application of the inventive marking tape onto various kinds of articles or components.

The marking tape used in FIG. 5 comprises a carrier section or cover 11 which has been severed as shown in FIG. 4. The diametrically opposite lugs 6 of the cover 11 are used for the attachment of the marking tape to an electric cable 12. To this end, a fastening strip 13 has been threaded through the openings 7 of the lugs 6 and encircles the electric cable 12. Owing to the arcuate curvature of the cable 12, the fastening strip, too, will get an arcuate configuration, which will further ensure the retainment of the marking plates 10 within the carrier section of cover 11. The fastening strip 13 used may be a simple metal strip which can be bent around the cable 12, or it may be a tie strip of the kind commercially available under the trade mark TY-WRAP.

Figure 6:
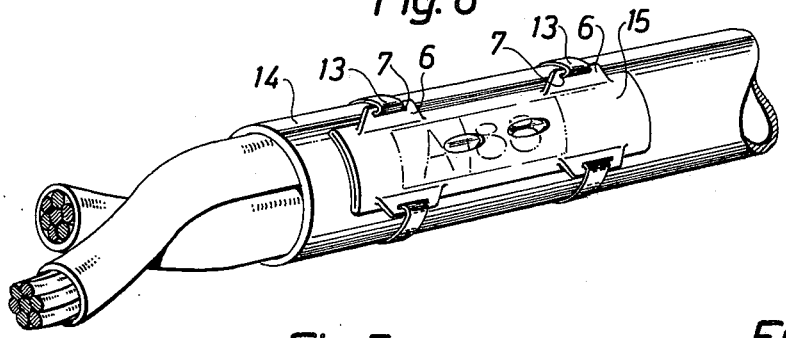

FIG. 6 illustrates an inventive marking tape having a carrier section or cover 15 which has been severed from the carrier hose or tube 1 of FIG. 2 in a slightly different way. Thus, the carrier section or cover 15 has two pairs of integral lugs 6 for fastening the marking tape to an electric cable 14. As a consequence, the fastening has been executed by means of two fastening or tie strips 13.

Figure 7:
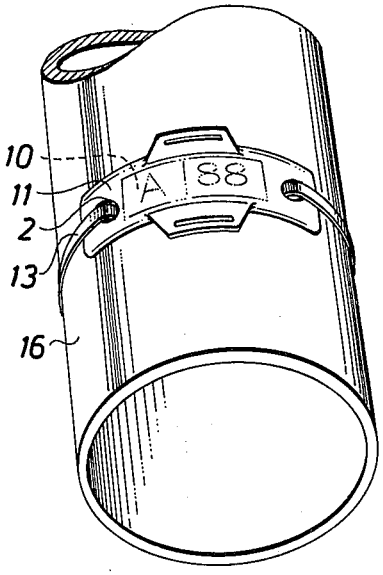

In the case of FIG. 7, the carrier section or cover according to FIG. 2 has been employed again, but the attachment to the article or component, here in the form of a pipe conduit 16, has been effected by utilising the holes 2. The fastening strip 13 has been threaded through these holes 2 and then bent around the conduit 16. This will also result in a closure of the open ends of the carrier section or cover 11, which will, of course, contribute to the retainment of the marking plates 10 within the cover.

Figure 8:
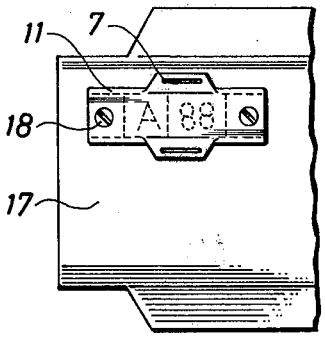

It would also be possible, however, to fasten marking tapes according to the invention onto components of various designs which are not suited for the use of fastening strips of the kind described hereinbefore, by screws, rivets or other similar fasteners, as indicated at 18 in FIG. 8. Thus, the marking tape according to the invention can be used for any type of components 17, such as printed-circuit cards in the electronics art, motors control devices etc. In such cases, either the holes 2 or the recesses or apertures 7 can be utilized.

Figure 9:
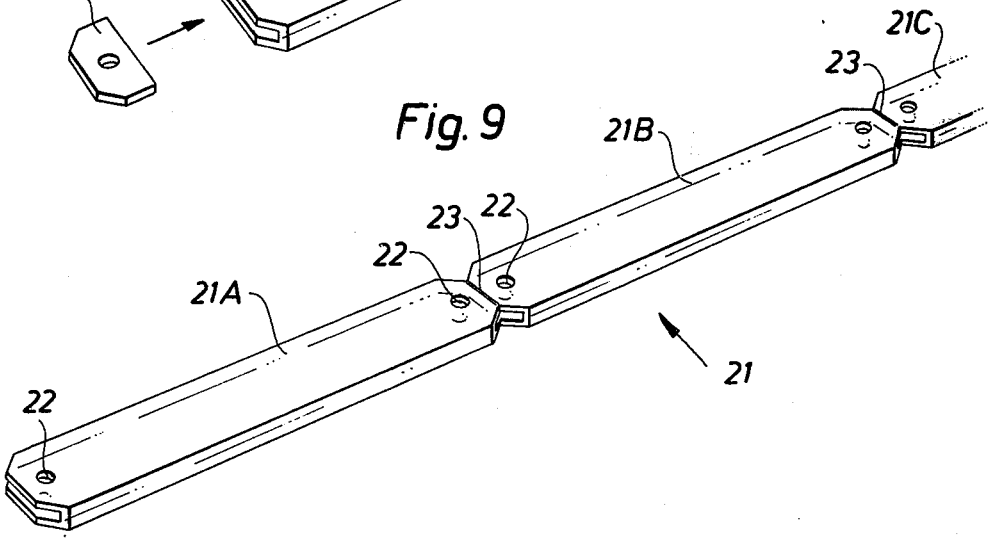

A further constructional form of the marking tape is illustrated in FIG. 9 which shows the carrier hose or tube 21 designed with a rectangular cross-section and with holes 22 for fixation to the article to be marked. The carrier hose or tube 21 again is manufactured in continuous lengths, and for the purpose of severing a carrier section or cover 21A, 21B etc. notches 23 are cut in the low longitudinal edges of the carrier hose or tube 21, such notches 23 serving as indications of fracture.

Figure 10:
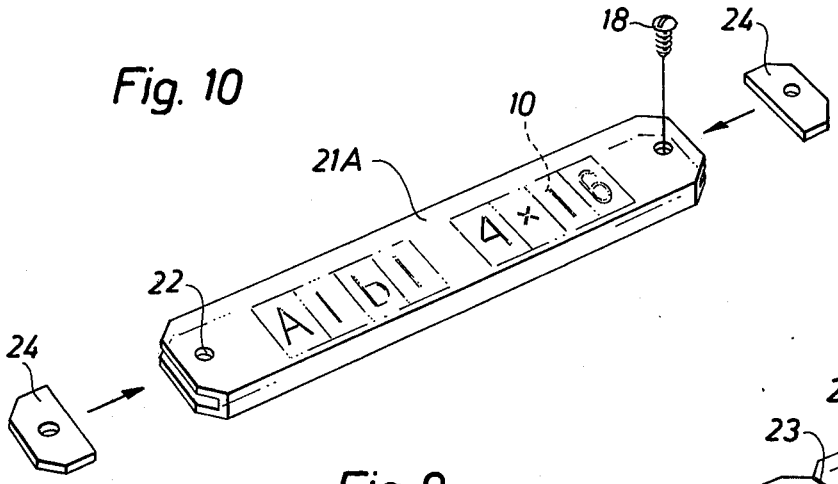
FIGS. 9 through 11 illustrates further embodiments of the marking tape and its assembly.

When fastening a carrier section or cover 21A, 21B, as shown in FIG. 10, the text composed of marking plate strips 10 (FIG. 3) can be introduced into the carrier section or cover prior to its fastening to its fixation to the article, which fixation may be effected by fastening strips 13 or by screws or rivets 18. When using screw or rivet fasteners 18, it is of advantage to use a flat end closure 24 serving to stiffen the end portions of the carrier sections or covers 21A, 21B.

Figure 11:
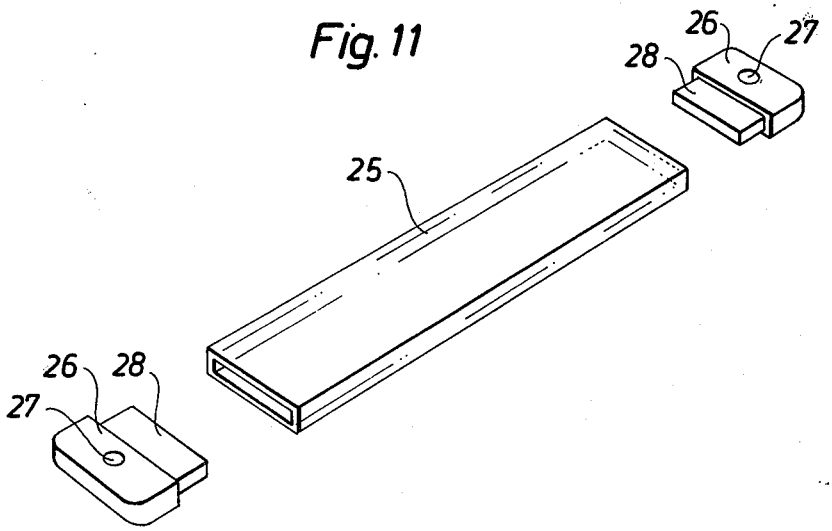

FIG. 11 illustrates a still further embodiment in which the carrier hose or tube 25 is devoid of holes and the attachment of which is intended to be effected by means of flat end closures which are provided with fastening holes 27 and include a plug portion 28 mating the interior dimensions of the carrier section or cover 25 and adapted, in the mounting operation, to be inserted into the end opening of the carrier section or cover 25. As in the case of the end closure plate 24, the end closure plates 26 are preferably made of a hard material, such a PVC, It will be understood from the embodiments of the marking tape according to the invention as described hereinbefore, that this tape can be varied in design without departing from the scope of the invention. The invention, therefore, must not be considered as restricted to the embodiments hereinbefore described and as illustrated in the accompanying drawings, but may be modified in different ways within the scope of the appended claims.

I claim:

1. A marking device for marking articles such as electric cables, pipe conduits and the like, and comprising at least one marking plate carrying marking indicia, a support for said marking plate in the form of a resilient, flexible, transparent tubular hose the greatest inner dimension of which is less than the width of said marking plate, said tubular hose assuming a shape of circular cross-section symmetrical about its center axis when relaxed, said marking plate being inserted into the cover thereby resiliently distorting said cover from its symmetrical relaxed shape whereby said marking-plate is positively retained in said hose with the indicia of the marking plate readable through the support, means for attachment of said support and inserted marking plate to the article to be marked, said attachment means including spaced holes in said tubular hose along at least one straight line in the peripheral surface of said hose in parallel relation to the center axis thereof, and fastening elements for cooperation with said holes to attach said hose to the article to be marked.

2. A marking device according to claim 1, wherein said hose is provided with rows of holes disposed in diametrically opposite positions.

3. A marking device according to claim 1, wherein said attachment means comprises at least one row of lugs projecting outward from the peripheral surface of the hose, each of said lugs being provided with an aperture for fastening to the article to be marked.

4. A marking device according to claim 1, wherein said support comprises a cut-off section of a length of hose which is pre-fabricated and includes a continuous repetition of groups of holes.

5. A marking device according to any claim 1, wherein said marking plate is in the form of a section of a pre-fabricated marking plate strip cut off at a preselected length.

6. A marking device according to claim 1, wherein said fastening elements comprising fastening strips.

7. A marking device according to claim 1, wherein said fastening elements comprise rivets or screws.

* * * * *